US011437702B2

(12) United States Patent
Han et al.

(10) Patent No.: US 11,437,702 B2
(45) Date of Patent: Sep. 6, 2022

(54) ANTENNA MOUNTING STRUCTURE

(71) Applicant: KMW INC., Hwaseong-si (KR)

(72) Inventors: Yong Hee Han, Seoul (KR); Seong-man Kang, Hwaseong-si (KR); In Ho Kim, Yongin-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 17/145,373

(22) Filed: Jan. 10, 2021

(65) Prior Publication Data

US 2021/0135331 A1 May 6, 2021

Related U.S. Application Data

(63) Continuation of application No. PCT/KR2019/008539, filed on Jul. 11, 2019.

(30) Foreign Application Priority Data

Jul. 11, 2018 (KR) ..... 10-2018-0080544
Jul. 9, 2019 (KR) ..... 10-2019-0082564

(51) Int. Cl.
*H01Q 1/12* (2006.01)
*H01Q 1/00* (2006.01)

(52) U.S. Cl.
CPC ..... *H01Q 1/1221* (2013.01); *H01Q 1/005* (2013.01)

(58) Field of Classification Search
CPC ..... H01Q 1/22; H01Q 1/1221; H01Q 1/1264; H01Q 1/005
See application file for complete search history.

(56) References Cited

U.S. PATENT DOCUMENTS 2,717,751 A * 9/1955 Kusiv ..... H01Q 1/1221 248/539
6,018,325 A 1/2000 Lundgren

FOREIGN PATENT DOCUMENTS

| | | | | |
|---|---|---|---|---|
| FR | 2791182 | A1 * | 9/2000 | ..... H01Q 1/1221 |
| JP | 58-129805 | A | 8/1983 | |
| JP | H07-307606 | A | 11/1995 | |
| JP | 2002-374110 | A | 12/2002 | |
| JP | 2003-008316 | A | 1/2003 | |
| JP | 2003-069322 | A | 3/2003 | |
| JP | 2004-064195 | A | 2/2004 | |

(Continued)

OTHER PUBLICATIONS

International Search Report for PCT/KR2019/008539 dated Oct. 17, 2019 and its English translation.

(Continued)

*Primary Examiner* — Hoang V Nguyen
(74) *Attorney, Agent, or Firm* — Insight Law Group, PLLC; Seung Lee

(57) ABSTRACT

An antenna mounting structure is disclosed. According to an embodiment of the present invention, provided is an antenna mounting structure comprising: a parapet mount part; a parapet contact part vertically connected to one end of the parapet mount part; a mount extension part vertically connected to the other end of the parapet mount part, disposed parallel to the parapet contact part, and is connected and fixed to an inner surface of a parapet wall by means of a first connecting means; and an antenna coupling part adjacently disposed to the parapet contact part and configured to be coupled with an antenna.

14 Claims, 12 Drawing Sheets

(56) References Cited

FOREIGN PATENT DOCUMENTS

| | | | |
|---|---|---|---|
| JP | 2013-090054 | A | 5/2013 |
| KR | 20-0293991 | Y1 | 11/2002 |

OTHER PUBLICATIONS

Japanese office action dated Feb. 22, 2022 for Japanese Application No. 2021-500738 and its English translation.

* cited by examiner

ANTENNA MOUNTING STRUCTURE

CROSS-REFERENCE TO RELATED APPLICATIONS

This application is a continuation of International Application No. PCT/KR2019/008539, filed on Jul. 11, 2019, which claims the benefit of Korean Patent Application No. 10-2018-0080544, filed on Jul. 11, 2018, in the Korean Intellectual Property Office and Korean Patent Application No. 10-2019-0082564, filed on Jul. 9, 2019, in the Korean Intellectual Property Office, the disclosures of which are incorporated herein in theft entirety by reference.

BACKGROUND

1) Field

The disclosure relates to an antenna mounting structure.

2) Description of Related Art

The statements in this section merely present background knowledge for the disclosure, and do not constitute prior art.

In order to secure a long transmission/reception distance, an antenna for wireless communications is generally installed on a high place where the surroundings are not obstructed. As such, the antenna is usually installed on a utility pole, a pylon, or a roof of a building, and particularly in urban areas, is often installed on the roof of the building.

On the other hand, when the antenna is installed on the roof of the building, a system is usually used in which a pole for standing and supporting the antenna vertically upright is first installed on the roof and then the antenna may be fixed and installed on the pole.

In this case, the pole is generally fixed to the floor of the building roof using an anchor or the like, or fixed to a separate heavy object.

However, when the pole is fixed to the floor of the building roof, punching a hole of fairly large size in the floor of the building roof for inserting the pole becomes necessary, which causes damage to the building.

On the other hand, in the case of supporting the pole by using a heavy object, a situation could arise in which the pole and the heavy object are blown down by strong winds on a windy day. This may lead to safety accidents and it may be cumbersome to re-erect the blown down pole and the heavy object.

In addition, when installing the pole on the heavy object, the installation process may also be attended with difficulties such as having to use a separate ladder car to move the heavy object to the roof of the building.

On the other hand, when multiple antennas are installed on the roof of the building by using multiple poles without regard to aesthetic elements, the external appearance of the building may become disfigured.

SUMMARY

Accordingly, the disclosure is to provide an antenna mounting structure that stably supports an antenna while minimizing damage to the building.

Also, the disclosure is to provide an antenna mounting structure capable of easily adjusting an installed state of an antenna.

Further, the disclosure is to provide an antenna mounting structure capable of fulfilling an original function of an antenna while preventing the disfigurement of urban scape and exterior appearances of buildings.

Still further, the disclosure is to provide a structure connection in which a plurality of antenna mounting structures are stably mounted while producing an aesthetic impression.

According to an embodiment of the present invention, provided is an antenna mounting structure including: a parapet mount part; a parapet contact part vertically connected to one end of the parapet mount part; a mount extension part vertically connected to the other end of the parapet mount part, disposed parallel to the parapet contact part, and connected and fixed to an inner surface of a parapet wall by means of a first connecting means; and an antenna coupling part adjacently disposed to the parapet contact part and configured to be coupled with an antenna.

Also, provided is the antenna mounting structure also including an angling wire connected to an upper end of the antenna at one end; and an angling part configured to adjust a degree of tilt of the antenna by length adjustment of the angling wire.

In addition, provided is the antenna mounting structure wherein the angling part may be a turnbuckle, wherein one end of the turnbuckle is connected to a first wire of the angling wire that is connected to the upper end of the antenna and the other end of the turnbuckle is connected to a second wire that is connected to the antenna mounting structure.

Moreover, provided is the antenna mounting structure wherein the angling part may be a first winding roller, wherein one end of the angling wire is connected to an upper end of the antenna, and the first winding roller is configured to wind around the other end region of the angling wire.

Further, provided is the antenna mounting structure wherein the angling part may include a second winding roller, one end of the angling wire is connected to an upper end of the antenna, and the second winding roller configured to wind around the other end region of the angling wire; a warm gear connected with the second winding roller; and a worm engaged with the warm gear.

Further, provided is the antenna mounting structure wherein the parapet mount part may include a contact part connection connected to the parapet contact part, and an extension part connection connected to the mount extension part, and a portion of the contact part connection is inserted into the extension part connection, and a length of the parapet mount part is adjusted depending on a degree of insertion.

Further, provided is the antenna mounting structure wherein a distance between an inner surface of a parapet wall and the mount extension part may be adjusted by adjusting a length of the first connecting means or changing a fastened state of the first connecting means to the inner surface of the parapet wall.

Further, provided is the antenna mounting structure wherein the mount extension part may also include a vertical extension portion vertically connected to the parapet mount part, a first auxiliary extension portion vertically coupled to the vertical extension portion, both ends of the first auxiliary extension portion is fixed by the first connecting means.

Further, provided is the antenna mounting structure wherein the parapet wall may be in a form of an "L" shape including a first area perpendicular to the ground and a second area perpendicular to an end of the first area and parallel to the ground, the mount extension part also includes a second auxiliary extension portion configured to be connected and fixed to a lower surface of the second region of the parapet wall by means of a second connecting means.

Further, provided is the antenna mounting structure wherein the antenna coupling part may include a lower coupling body, and upper coupling body coupled to an upper area of the lower coupling body, and one or more first rotating coupling holes are formed on the lower coupling body, and the one or more first rotating coupling holes are arranged along an outer circumference of the lower coupling body to adjust rotary arrangement.

Further, provided is the antenna mounting structure wherein a second rotating coupling hole may be formed in a region of the upper coupling body connected to the lower coupling body, the second rotating coupling hole is configured to adjust a tilted state of the antenna.

Further, provided is the antenna mounting structure wherein the antenna mounting structure may also include a wire mount unit configured to mount the angling wire.

Further, provided is the antenna mounting structure wherein the antenna may be disposed to extend in a direction parallel to the parapet contact part.

Further, provided is the antenna mounting structure also including a mount panel disposed below the parapet mount part.

Further, provided is a connection structure connecting a plurality of antenna mounting structures, including one or more structure connections that are connected to the parapet mount part of each of the antenna mounting structures adjoining each other to fix the plurality of antenna mounting structures.

DETAILED DESCRIPTION

Figure 1:
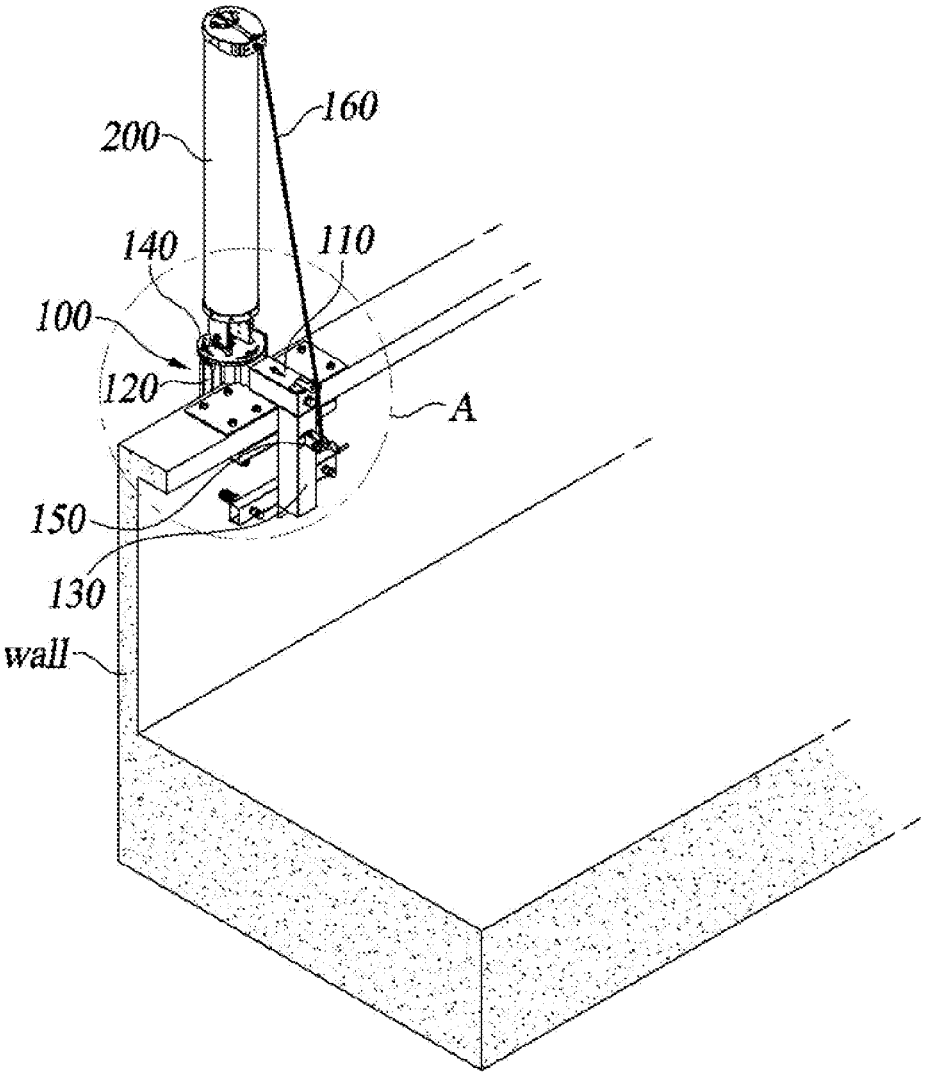
FIG. 1 is a perspective view showing a construction of an antenna mounting structure, in accordance with an embodiment of the disclosure.

In the following, some embodiments of the disclosure will be described in detail with reference to illustrative drawings. It should be noted that, in labeling each element in the drawings with reference numbers, whenever possible, the same elements are intended to have the same reference numbers even though they are indicated in different drawings. In addition, in describing the disclosure, known components or features involved are not described in detail in order not to obscure the subject matter of the disclosure.

The designations such as "a first", "a second", "i)", "ii)", "a)", "b)", and so forth may be used herein to describe the components of the embodiments according to the disclosure. These designations are just to distinguish one element from the other elements, and do not limit the essence or sequence, order or the like of those components. As used herein, reference to "include," "includes," "including," "comprise," "comprises," "comprising," or any variation thereof, indicates that any part that comprises any element does not exclude any other elements, but may also include other elements, unless expressly stated otherwise.

FIG. 1 is a perspective view showing a construction of an antenna mounting structure 100 in accordance with an embodiment of the disclosure.

Figure 2:
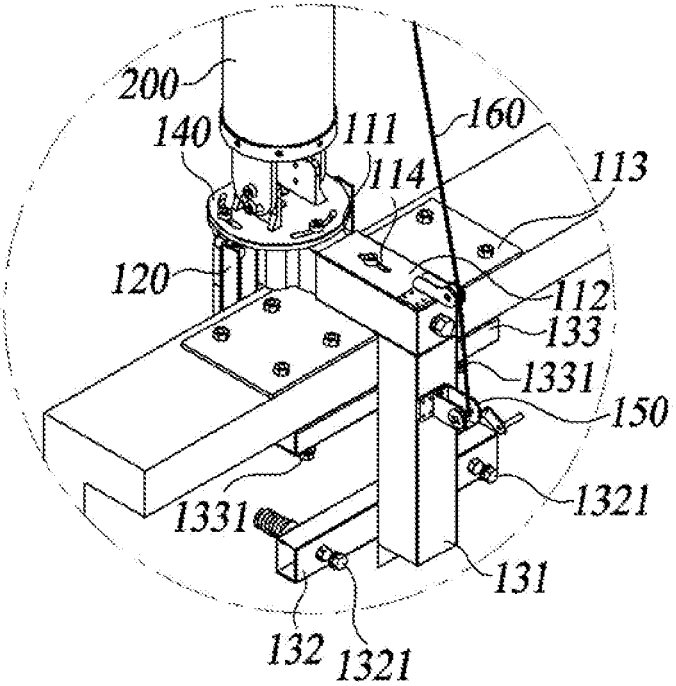
FIG. 2 is an enlarged perspective view of a portion A in FIG. 1.
Figure 3:
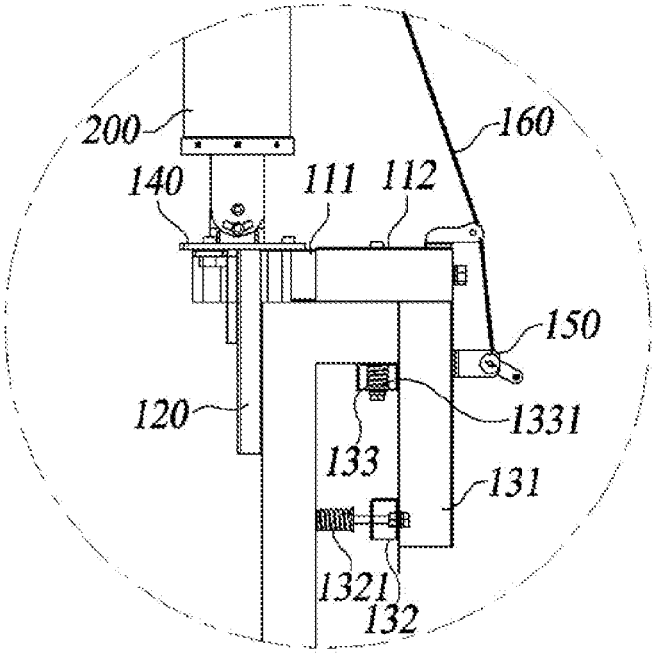
FIG. 3 is a side view showing the antenna mounting structure being mounted on a parapet wall, in accordance with an embodiment of the disclosure.

FIG. 2 is an enlarged perspective view of a portion A in FIG. 1, and FIG. 3 is a side view showing the antenna mounting structure 100 being mounted on a parapet wall, in accordance with an embodiment of the disclosure.

Referring to FIGS. 1-3, an antenna mounting structure 100 according to the embodiment of the disclosure includes a parapet mount part 110, a parapet contact part 120, a mount extension part 130, and an antenna coupling part 140.

On the other hand, the antenna mounting structure 100 according to an embodiment of the disclosure is shown in the most suitable construction to be installed on an "L" shaped parapet wall as shown in FIGS. 1-3.

However, the antenna mounting structure 100 according to an embodiment of the disclosure may be installed on other shaped parapet walls, for example, a simple vertical wall.

On the other hand, the parapet mount part 110 is mounted on the top surface of the parapet wall, whereby the antenna mounting structure 100 according to an embodiment of the disclosure is supported by the top surface of the parapet wall.

Also, although being formed integrally, the parapet mount part 110 may be formed of separate components, a contact part connection 111 and an extension part connection 112 so that the length thereof may be adjusted, as shown in FIGS. 1-3.

Herein, the contact part connection 111 is connected to the parapet contact part 120, and the extension part connection 112 is connected to the mount extension part 130. As such, the parapet contact part 120 and contact part connection 111 may be connected to form a shape, and the mount extension part 130 and the extension part connection 112 may be formed into an "L" shape.

Further, the contact part connection 111 is inserted and slid into the extension part connection 112, such that the length of the parapet mount part 110 may be adjusted.

This allows the length of parapet mount part 110 to be adjusted to match the width of the top surface of the parapet wall. Therefore, although the parapet walls are of unequal size for each building, the antenna mounting structure 100 may be installed by adjusting the length of the parapet mount part 110 so as to be suitable size for the parapet wall to be installed.

Specifically, a length adjusting hole 114 which is an oblong hole for adjusting the length of the parapet mount part 110 is formed on the extension part connection 112.

Forming the length adjusting hole 114 on the extension part connection 112 allows the length of the parapet mount part 110 to be appropriately adjusted by adjusting the inserted length of the contact part connection 111 into the extension part connection 112 and then fastening a fastening bolt to the length adjusting hole and a combination hole (not shown) on the contact part connection 111.

On the other hand, at one end region of the parapet mount part 110, i.e., at an end portion of the contact part connection 111, the parapet mount part 120 is vertically connected to the parapet contact part 110. Likewise, at the other end region of the parapet mount part 110, i.e., at an end portion of the extension part connection 112, the mount extension part 130 is vertically connected to the parapet contact part 110.

It should be noted that although in this case the parapet mount part 110 is shown by way of example in FIG. 1 as being formed separately from the mount extension part 130 and the parapet contact part 120 and bolt fastened therewith, it is also possible that parapet mount part 110 may be integrally formed with the mount extension part 130 or the parapet contact part 120 as described above.

Additionally, as shown in FIG. 1, a mount panel 113 is disposed between the parapet mount part 110 and the top surface of the parapet wall.

Disposing the mount panel 113 between the parapet mount part 110 and the top surface of the parapet wall allows the lower surface of the parapet mount part 100 to be tightly supported on the mount panel 113, so that parapet mount part 110 may be stably supported.

The parapet contact part 120 is vertically coupled to one end region of the parapet mount part 110 on the outside of the parapet wall, and gets in contact with the outside surface of the parapet wall.

In this case, the contact force of the inner surface of the parapet contact part 120 on the outside surface of the parapet wall may be adjusted by adjusting the distance between the inner surface of the mount extension part 130 and the inner surface of the parapet wall, as will be described in detail later.

The mount extension part 130 includes a vertical extension portion 131, a first auxiliary extension portion 132 and a second auxiliary extension portion 133.

The vertical extension portion 131 is vertically extended and coupled to an end region of the parapet mount part 110 facing inward of the parapet wall. In this case, the vertical extension portion 131 and the parapet contact part 120 are arranged in parallel to each other to extend in the same direction from the parapet mount part 110 across the parapet wall.

In this case, the vertical extension portion 131 and the parapet contact part 120 are arranged in parallel to each other to extend in the same direction from the parapet mount part 110 across the parapet wall. The first connecting means 1321, for example, may be a first connecting screw, by which the degree of fastening to the inner surface of the parapet wall, and thus the distance from an end portion thereof to the inner surface of the parapet wall may be adjusted.

In this case, the distance between the first auxiliary extension portion and the inner surface of the parapet wall may be adjusted by adjusting the degree of fastening of the first connecting means 1321 to the parapet wall, or the length of the first connecting means 1321.

In this case, also by adjusting the first connecting means 1321 such that the first auxiliary extension portion 132 gradually becomes further away from the inner surface of the parapet wall, it is possible to further bring the parapet contact part 120 into close contact with the outer surface of a parapet wall.

In this way, the antenna mounting structure 100 according to an embodiment of the disclosure may be firmly and tightly fixed to the parapet wall.

On the other hand, although the first connecting means 1321 is shown as being connected to both end regions of the first auxiliary extension portion 132 in FIG. 2, any other number and arrangement of the first connecting means 1321 may be disposed.

The second auxiliary extension portion 133 is adjacent to the bottom surface of a top plate of the parapet wall and vertically coupled to the vertical extension portion 131. Also, the second auxiliary extension portion 133 is connected to the bottom surface of the top plate of the parapet wall by means of a second connecting means 1331.

On the other hand, in this case, the second connecting means 1331 may be a second connecting screw, by which the distance from the bottom surface of the top plate of the parapet wall to an end portion thereof may be adjusted by the length adjustment or the fastened state on the bottom surface of the top plate of the parapet wall.

In this case, the distance between the top plate of the parapet wall and the second auxiliary extension portion 133 is adjusted by adjusting the fastened state of the second connecting means 1331 to the top plate of the parapet wall or the length of the second connecting means 1331. In this case, the more the distance between the top plate of the parapet wall and the second auxiliary extension portion 133 is, the closer the parapet mount part 110 may be brought into close contact with the top surface of the parapet wall.

The antenna coupling part 140 is coupled to the parapet contact part 120 or the parapet mount part 110, and the antenna 200 is coupled to and supported on the antenna coupling part 140.

In this case, the antenna 200 coupled to the antenna coupling part 140 may be adjusted in the orientation to be mounted and a degree of tilt thereof as will be described in detail later.

It should be noted that although the parapet mount part 110, the parapet contact part 120, and the mount extension part 130 have been described in the foregoing description as being each of separate components, this is just notional.

In other words, it should be noted that the parapet mount part 110 may be integrally formed with either one of the parapet contact part 120 and the mount extension part 130, and that all of the parapet mount part 110, the parapet contact part 120, and the mount extension part 130 may be integrally formed.

Figure 4:
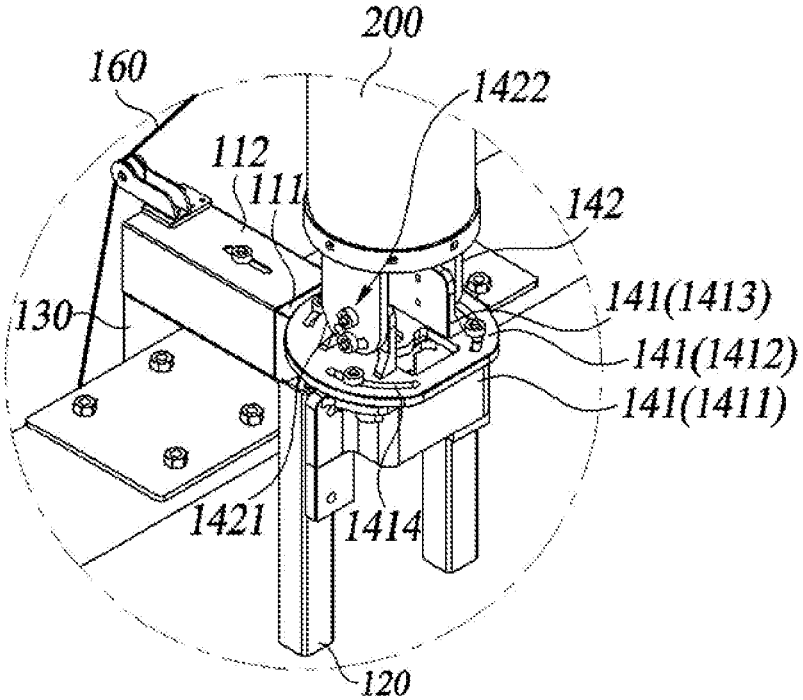
FIG. 4 is a perspective view for illustrating a construction of an antenna coupling part of the antenna mounting structure, in accordance with an embodiment of the disclosure.
Figure 5:
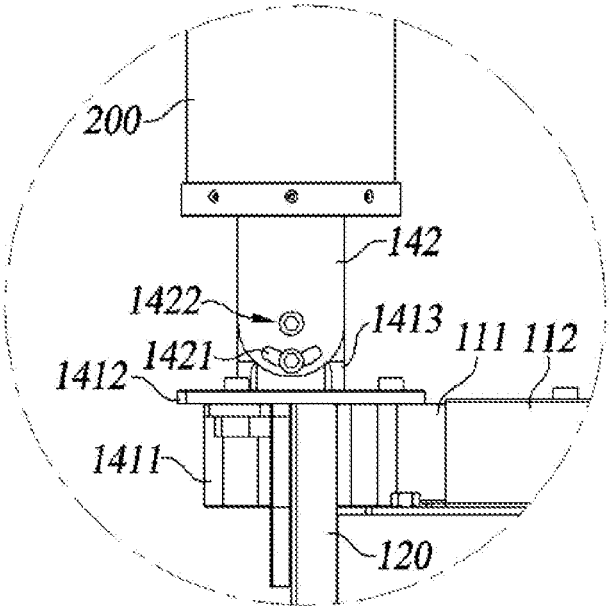
FIG. 5 is a side view for illustrating a construction of the antenna coupling part of the antenna mounting structure, in accordance with an embodiment of the disclosure.

FIGS. 4-5 are a perspective view and a side view for illustrating a construction of the antenna coupling part of the antenna mounting structure, respectively, in accordance with an embodiment of the disclosure.

Referring to FIG. 4, the antenna coupling part 140 of the antenna mounting structure 100 according to an embodiment of the disclosure includes a lower coupling body 141 and an upper coupling body 142.

The lower coupling body 141 is coupled onto the parapet contact part 120. The lower coupling body 141 may include a contact portion coupling body 1411, a coupling disc 1412, and an upper coupling body fixator 1413.

The contact portion coupling body 1411 is bonded on one side to the parapet contact part 120, on the upper surface of which is provided with a space the coupling disc 1412 would be bonded.

The coupling disc 1412 is coupled to the contact portion coupling body 1411 and the contact part connection 111.

On the other hand, one or more first rotating coupling holes 1414 may be included on the coupling disc 1412, which extend along an outer circumference thereof.

By passing one or more fastening bolts through the first rotating coupling holes 1414, this allows the coupling disk 1412 to be fastened to one or more combination holes (not shown) on the contact portion coupling body 1411 or the contact part connection 111, and allows the coupling disc 1412 to be coupled to and fixed on top of the contact portion coupling body 1411 and the contact part connection 111.

On the other hand, when the coupling disc 1412 is fixed on top of the contact portion coupling body 1411 and the contact part connection 111, the coupling disc 1412 may be arranged to rotate along its first rotating coupling holes 1414. Consequently, the antenna 200 may be arranged to be rotatable, so that the antenna 200 may be mounted in an appropriate orientation.

The upper coupling body fixator is formed on the coupling disc 1412, to which the upper coupling body 1412 is coupled.

On the other hand, combination holes (not shown) are formed on the upper coupling body fixator 1413 corresponding to positions of a second rotating coupling hole 1421 and an axial coupling hole 1422 formed on the upper coupling body 142 are formed.

In this case, the upper coupling body 1412 is coupled and fixed to the lower coupling body 141 by passing a fastening bolt through the second rotating coupling hole 1412 and the combination hole on the upper coupling body 142 and a fastening bolt through the axial coupling hole and the rotating coupling hole on the upper coupling body fixator 1413.

An end portion of the antenna 200 is coupled to and supported on the upper coupling body 140. Further, as previously described, the upper coupling body 142 is coupled to the top of the upper coupling body fixator 1413 of the lower coupling body 141.

A second rotating coupling hole 1421 is in the form of an elongated arc on the upper coupling body 142. As stated above, the fixing bolt passes through the second rotating coupling hole 1421 and is fastened to the combination hole (not shown) formed on the upper coupling body fixator 1413, thereby coupling and fixing the upper coupling body 142 to the lower coupling body 141.

As the second rotating coupling hole 1421 is in the form of an arc shape, a tilt of the upper coupling body 142 to the lower coupling body 141 may be angled.

In addition, a fastening bolt that penetrates an axial coupling hole 1422 formed in the upper coupling body 142 and is connected to the upper coupling body fixator 1413 of the lower coupling body 141 serves as an axis of rotation when the upper coupling body 142 is tilted relative to the lower coupling body 141.

By adjusting the tilt angle of the upper coupling body 142 in this way, consequentially the tilt of the antenna 200 may be angled.

As such, since the rotational arrangement of the antenna 200 and the tilt of the antenna 200 may be angled, the antenna mounting structure 100 according to an embodiment of the disclosure may appropriately adjust the installed state of the antenna 200.

Figure 6:
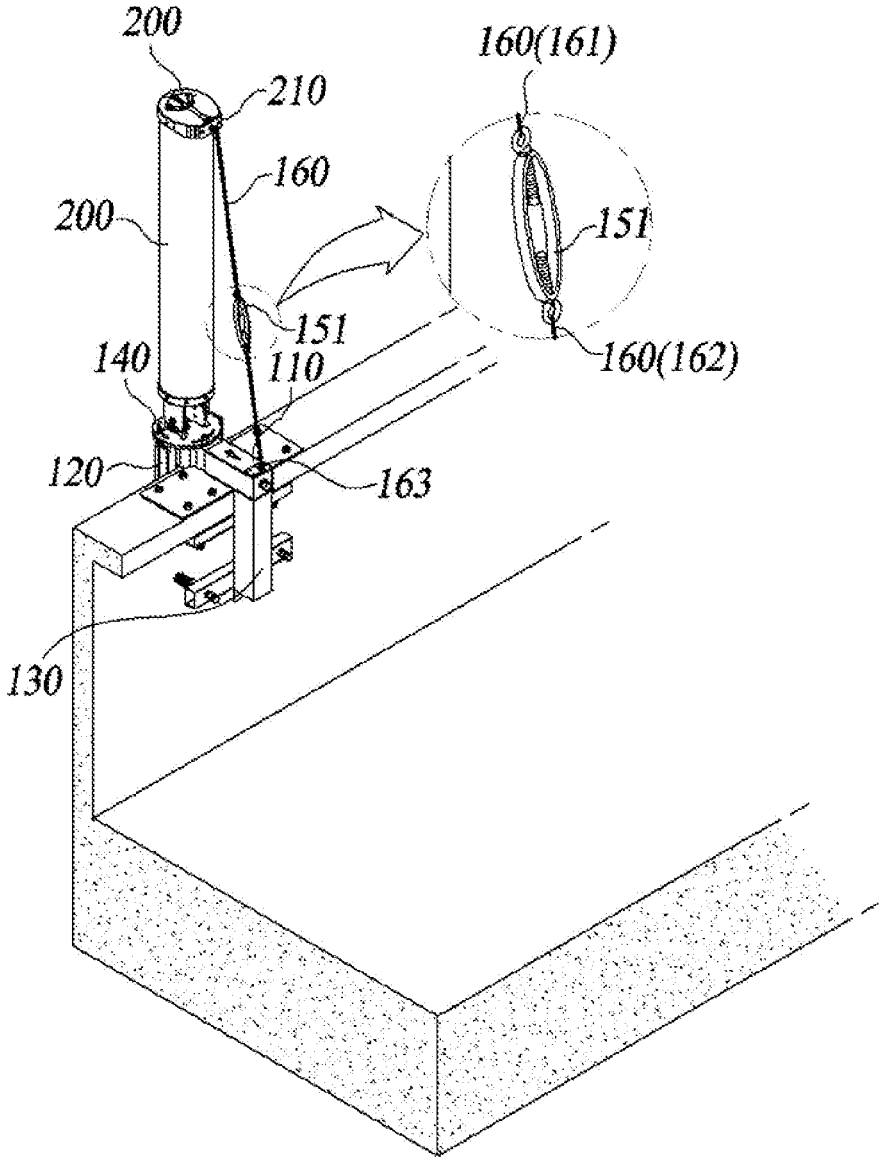
FIG. 6 shows a first configuration type of an angling part of the antenna mounting structure, in accordance with an embodiment of the disclosure.
Figure 7:
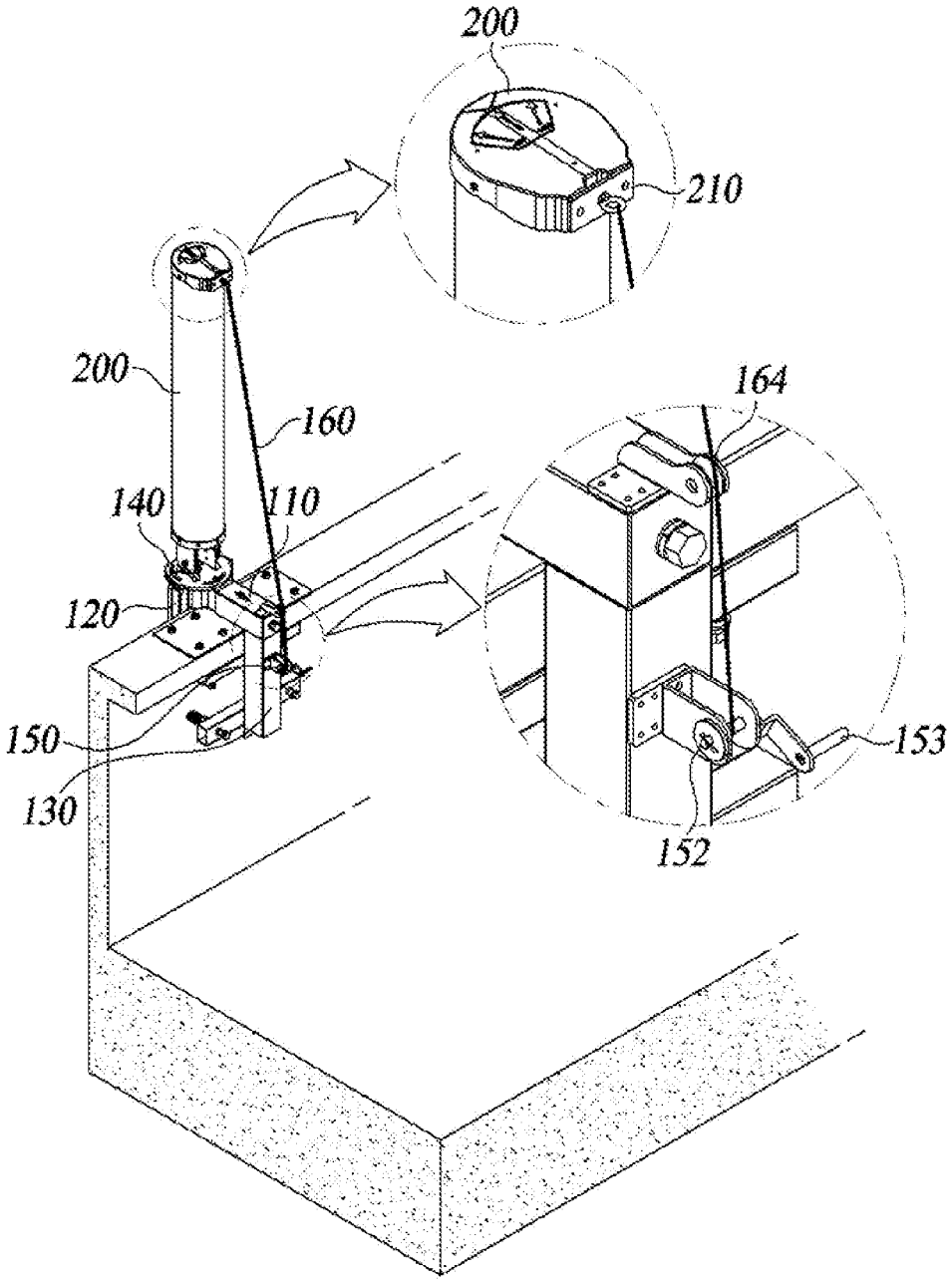
FIG. 7 shows a second configuration type of the angling part of the antenna mounting structure, in accordance with an embodiment of the disclosure.
Figure 8:
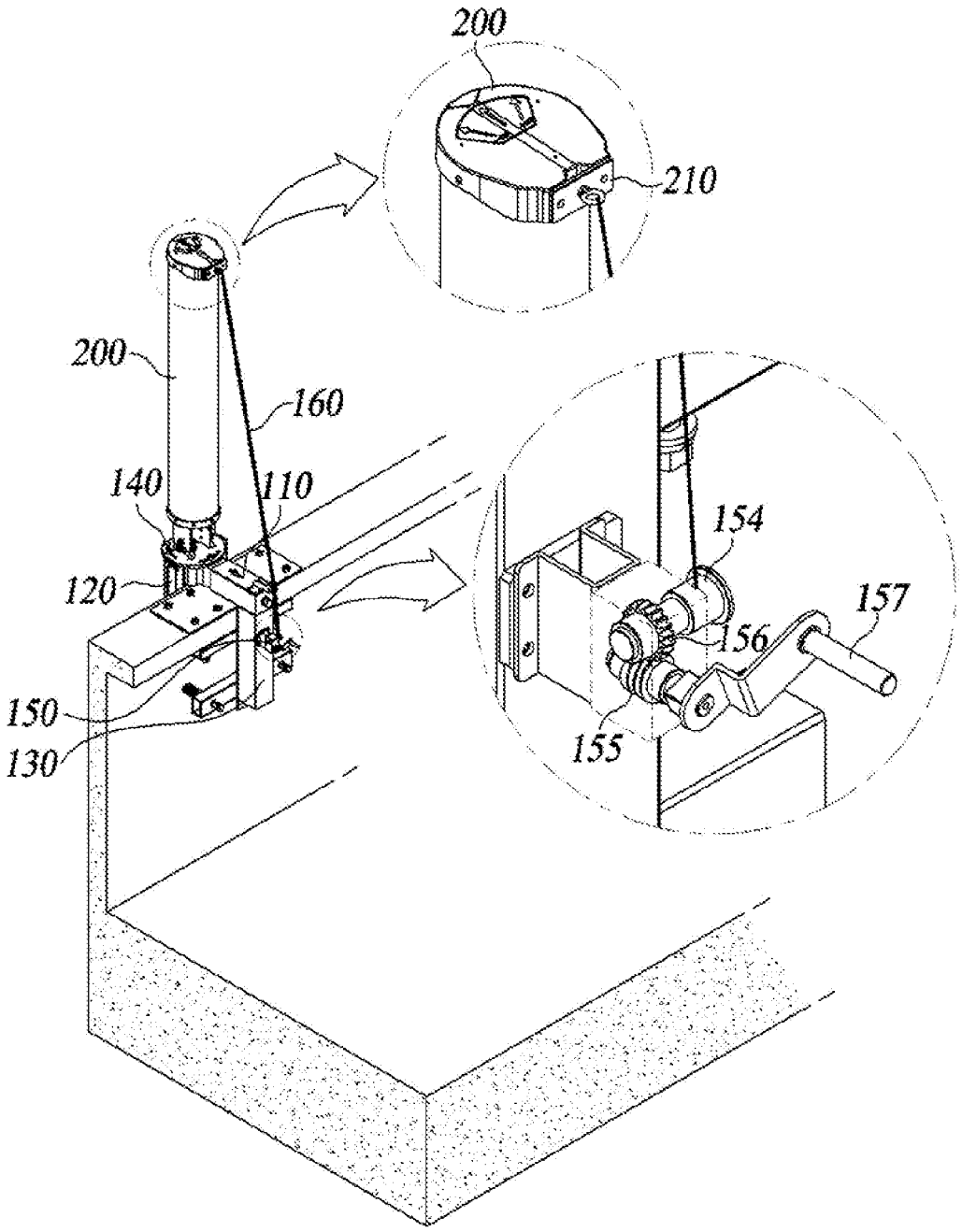
FIG. 8 shows a third configuration type of an angling part of the antenna mounting structure, in accordance with an embodiment of the disclosure.

FIGS. 6-8 show a first configuration type, a second configuration type and a third configuration type, respectively, of a angling part of the antenna mounting structure, in accordance with an embodiments of the disclosure.

Each of the types of the angling part 150 of the antenna mounting structure 100 according to an embodiment of the disclosure will now be further described in conjunction with FIGS. 6-8.

The angling part 150 is configured to adjust the degree of tilt of the antenna 200, and the tilt of the antenna 200 may be angled by adjusting a length of an angling wire 160 connected to an upper end of the antenna 200.

Turning to FIG. 6, the first type of the angling part 150 is configured as a turnbuckle 151.

Further, in this case, the angling wire 160 includes a first wire 161 connected to the upper end of the antenna 200 and one end of the turnbuckle 151, and a second wire 162 connected to a wire fixator 163 on the parapet mount part 110 and the other end of the turnbuckle 151.

On the other hand, in this case, one end of the first wire 161 may be directly connected to the upper end of the antenna 200, or may be connected to a connecting bolt 210 connected to the upper end the antenna 200 as shown in FIG. 6.

In this case, since the first wire 161 and the second wire 162 are connected to both ends of the turnbuckle 151, a distance between the upper end of the antenna 200 and the wire fixator 163 connected to each other by means of the first wire 161, turnbuckle 151 and second wire 162 may be adjusted by adjusting the turnbuckle 151.

By adjusting the distance between the upper end of the antenna 200 and the wire fixator 163 in this manner, a tilted state of the antenna 200 may be adjusted.

In this case, the turnbuckle 151, for example, commonly used frame type turnbuckle may be used.

In addition, in this case, a length change value of the turnbuckle 151 corresponding to each of tilt angle values of the antenna 200 may be a preset value, and with reference to this, the length of the turnbuckle 151 may be appropriately adjusted so as to allow antenna 200 to tilt at a desired angle when the antenna 200 is installed.

However, the first type of the turnbuckle 151 has to structurally restrict an angling range of the tilt of the antenna 200, and this limitation may be overcome by the second and the third configuration types of the angling part 150.

In FIG. 7, the second configuration type of the angling part 150 of the antenna mounting structure 100 according to an embodiment of the disclosure is shown consisting of a first handle 153 and a first winding roller 152, a winding degree of which is determined therewith.

In this case, one end of an angling wire 160 is connected to the upper portion of the antenna 200, and the other end region of the angling wire 160 is wound by the first winding roller 152.

Also, in this case, the angling wire 160 may be mounted to a wire mount unit 164 on the parapet mount part 110.

The angling wire 160 is wound around the first winding roller 152 by operating the first handle 153, wherein the number of windings of the angling wire 160 corresponds to the number of revolutions of the first handle 153. Thus, the tilt angle of the antenna 200 also corresponds to the number of revolutions of the first handle 153.

With this configuration, the tilt angle of the antenna 200 may be appropriately set by winding the first handle 153 correspondingly.

On the other hand, a plurality of fixing holes 152*a* for indicating the number of windings of the first winding roller 152 are formed on the first winding roller 152, and a fixing pin 152*b* is formed so as to be fixed to the respective fixing holes 152*a*.

In this case, the number of windings of the first winding roller 152 may be known by the fixing pin 152*b* being fixed to any one of the fixing holes 152*a* when the first winding roller 152 is wound.

In this case, the fixing holes 152*a* may be set to correspond to the tilt angle of the antenna 200.

In other words, for example, if the fixing pin 152*b* moves one hole of the fixing holes 152*a*, the tilt angle of the antenna 200 may be set to change by one degree.

Turning now to FIG. 8, the third configuration type of the angling part 150 is configured as a worm gear.

That is, in the third configuration type, the angling part 150 includes a second winding roller 154 around which a angling wire 160 is wound, a worm 155 connected to the second winding roller 154, a worm gear 156 engaged with the worm 155, and a second handle 157 connected to the worm gear 156.

In the third configuration type, the tilt angle of the antenna 200 may be more finely tuned by a gear ratio of the worm gear 156.

For example, assuming that the gear ratio of the worm gear 156 is 20:1 and the antenna 200 is tilted by 10 when the second winding roller 154 revolves one turn, it may be seen that the antenna 200 is tilted by just 0.5 when the handle is revolved one turn.

As such, in the third configuration type, there is an advantage that the arrangement of the antenna 200 may be more finely tuned by the gear ratio of the worm gear 156 as compared with the second configuration type.

Figure 9:
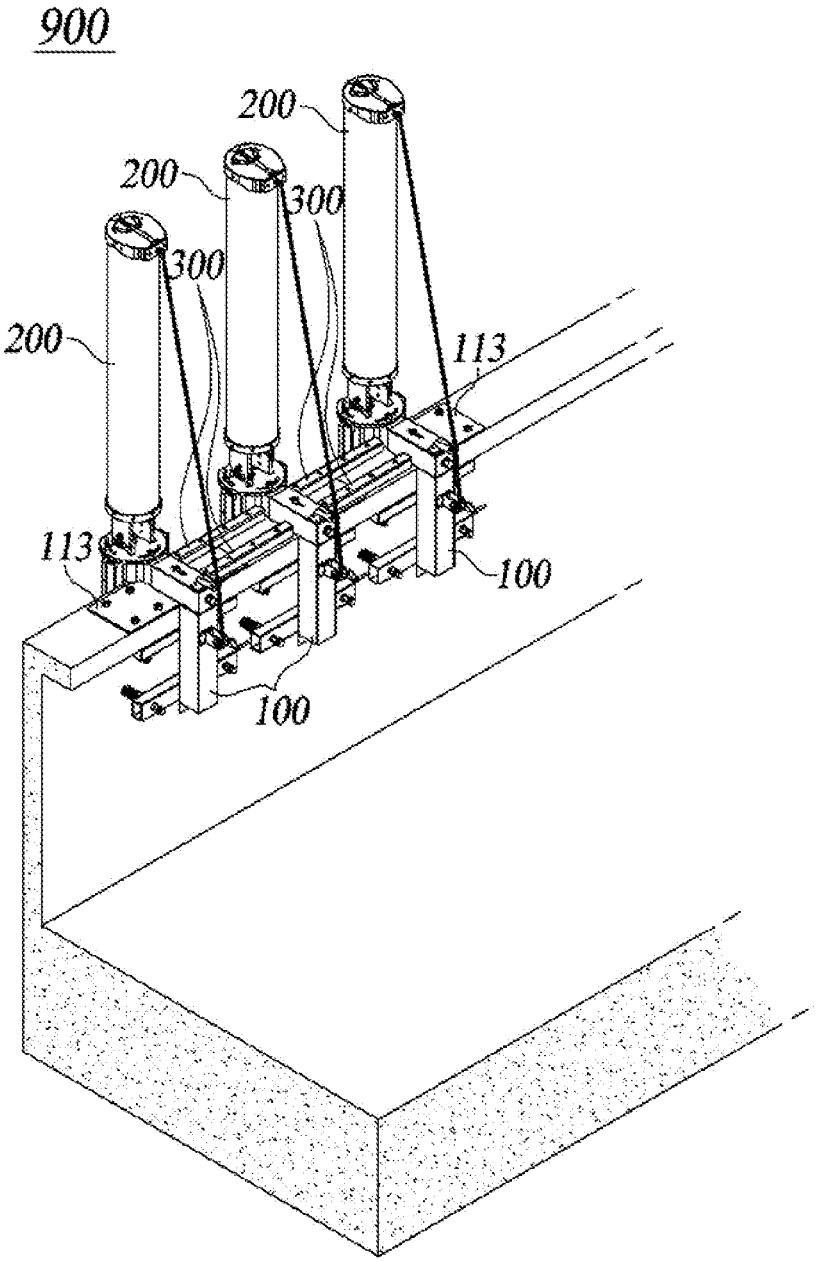
FIG. 9 shows a form of a connection structure, in which a plurality of antenna mounting structures are arranged, in accordance with an embodiment of the disclosure.

FIG. 9 shows a form of a connection structure 900, in which a plurality of antenna mounting structures 100 are arranged in accordance with an embodiment of the disclosure.

Referring to FIG. 9, a connection structure 900 according to an embodiment of the disclosure includes a plurality of antenna mounting structures 100 and structure connections 300 according to an embodiment of this invention.

The plurality of antenna mounting structures 100 are connected by the structure connections 300. In this case, the structure connections 300 are fixed on the mount panel 113 of the adjacent antenna mounting structure 100, so that the antenna mounting structures 100 adjoining each other are connected and fixed.

As such, in the connection structure 900 according to an embodiment of the disclosure, each antenna mounting structure 100 is not only tightly fixed on the parapet wall, but is once more fixed by being connected by the structure connection 300 with the adjacent antenna mounting structure 100.

With this configuration, the antenna mounting structure 100 according to an embodiment of the disclosure may be fixed more stably.

In addition, in this case, the antenna mounting structures 100 of the disclosure are arranged at regular intervals and the same in appearance by means of the structure connections 300, so that there is an advantage also of giving an aesthetic feeling.

Figure 10:
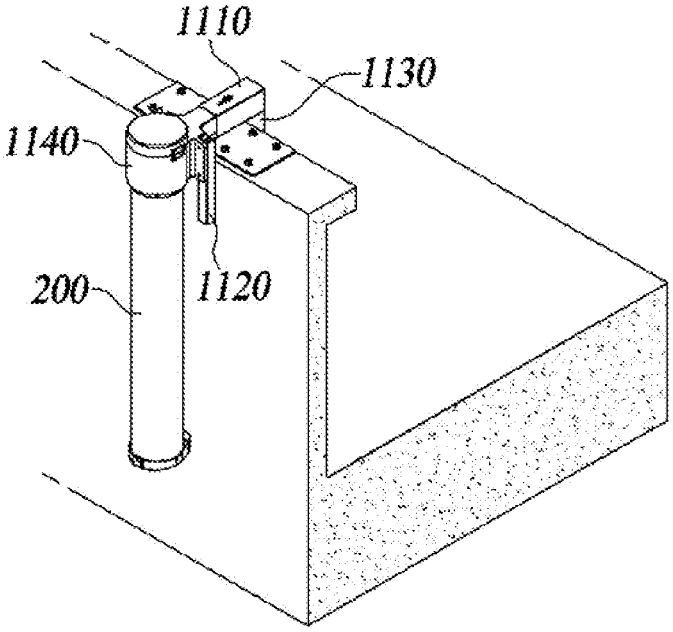
FIG. 10 is a perspective view showing a construction of an antenna mounting structure, in accordance with another embodiment of the disclosure.
Figure 11:
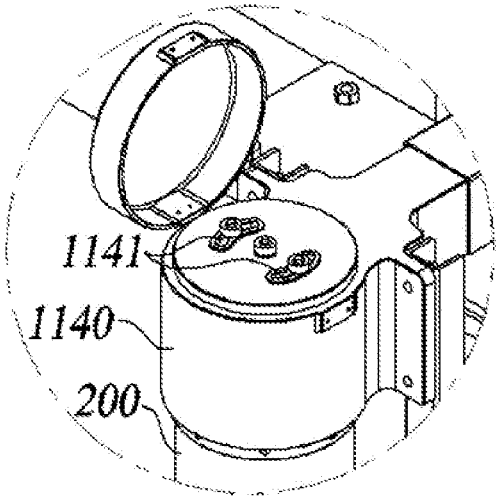
FIG. 11 is a perspective view for illustrating a construction of an antenna coupling part of the antenna mounting structure, in accordance with another embodiment of the disclosure.

FIG. 10 is a perspective view showing a construction of an antenna mounting structure 1100 in accordance with another embodiment of the disclosure, and FIG. 11 is a perspective view for illustrating a construction of an antenna coupling part 1140 of the antenna mounting structure 1100, in accordance with another embodiment of the disclosure.

Referring to FIG. 10, according to another embodiment of the disclosure, the antenna mounting structure 1100 includes a parapet mount part 1110, a parapet contact part 1120, and a mount extension part 1130, as with the antenna mounting structure 100 in accordance with an embodiment of the disclosure.

However, in the antenna mounting structure 1100 according to another embodiment of the disclosure, the antenna 200 is configured to extend downward along the outer surface of the parapet wall unlike the antenna mounting structure 100 according to an embodiment of the disclosure.

In addition, the antenna coupling part 1140 herein is in the form of a cup that receives one end region of the antenna 200, unlike the antenna coupled portion 140 of the antennas mounting structure 100 according to an embodiment of the disclosure.

In addition, in the antenna mounting structure 1100 according to another embodiment of the disclosure, the antenna 200 is formed to be rotatable on the antenna coupling part 1140.

In other words, as shown in FIG. 11, the antenna coupling part 1140 is configured so that its cover may be opened and closed, and an arc-shaped third locking coupling hole 1141 is formed on a surface, which is formed inside the cover and is disposed adjacent to the antenna 200.

In this case, the fastening bolt passes through the third rotating coupling hole 1141 and fastened to a fastening hole formed on a bottom surface of the antenna 200 (not shown).

In this case, the antenna 200 may be arranged to rotate along the third rotating coupling hole 1141, thereby allowing the antenna 200, when the antenna is installed, to be appropriately oriented.

Figure 12:
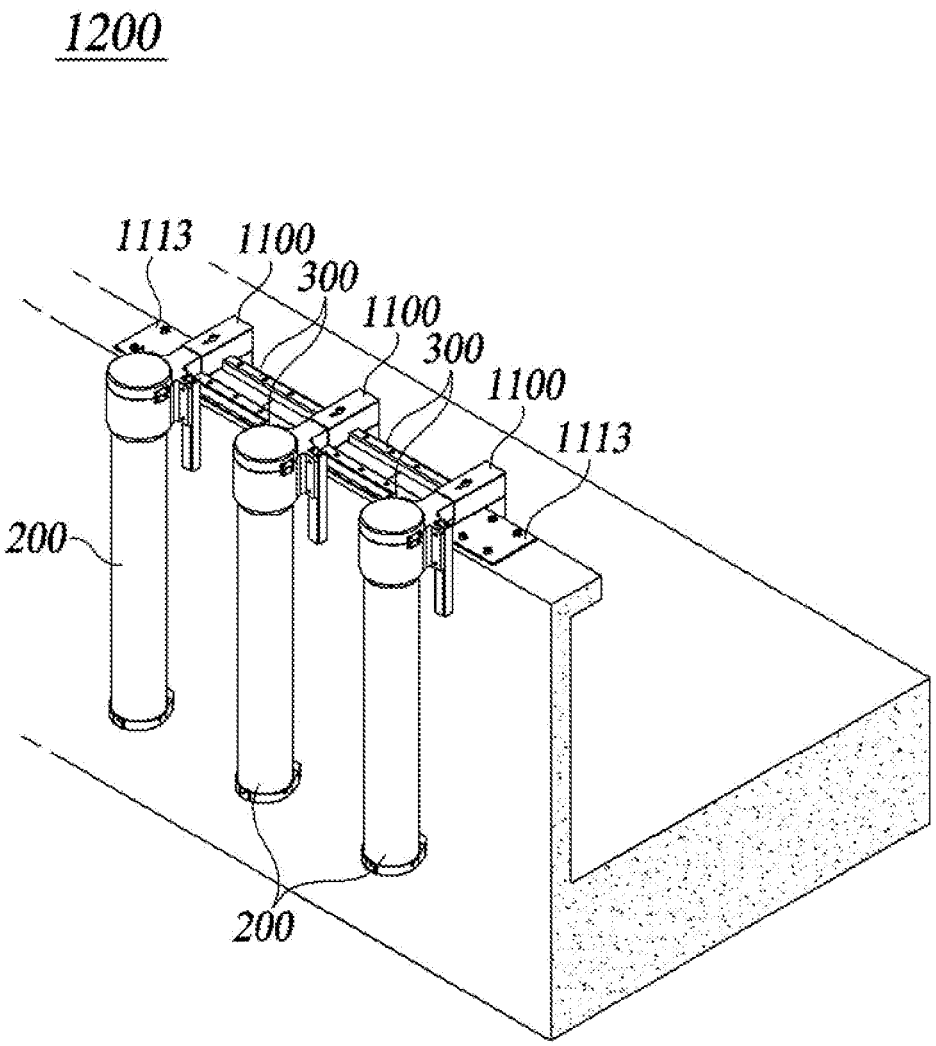
FIG. 12 is a view for illustrating a form of a connection structure, in which the plurality of antenna mounting structures are arranged, in accordance with another embodiment of the disclosure.

FIG. 12 shows a form of a connection structure 1200, in which the plurality of antenna mounting structures 1100 are arranged in accordance with another embodiment of the disclosure.

Referring to FIG. 12, in the connection structure 1200 according to another embodiment of the disclosure, the plurality of antenna mounting structures 1100 are arranged and connected.

Herein, in the connection structure 1200 according to another embodiment of the disclosure, a plurality of antenna mounting structures 1100 are connected and arranged by the structure connections 300, similarly to the connection structure 900 according to an embodiment of this invention.

In this case, the structure connections 300 are connected and fixed on the adjacent mount panel 1113 so that the antenna mounting structures 1100 adjoining each other are fixed to each other, whereby the antenna mounting structures 1100 are supported more stably.

The foregoing describes the technical idea of the embodiment by way of illustration only, and thus various modifications and variations may be made by one of ordinary skill in the art to which the embodiment belongs without departing from the essential attributes of the embodiment. Therefore, the embodiments are intended to illustrate, and not to limit the technical idea of the embodiment, and the scope of the technical idea of the embodiment is not limited to these embodiments. It is intended that the scope of protection of the embodiment shall be interpreted as set forth in the following claims and to encompass all technical ideas falling within range of equivalents thereof

What is claimed is:

1. An antenna mounting structure, comprising:

a parapet mount part;

a parapet contact part vertically connected to one end of the parapet mount part;

a mount extension part vertically connected to the other end of the parapet mount part, disposed parallel to the parapet contact part, and connected and fixed to an inner surface of a parapet wall by means of a first connecting means; and an antenna coupling part adjacently disposed to the parapet contact part and configured to be coupled with an antenna, wherein the parapet mount part comprises a contact part connection connected to the parapet contact part, and an extension part connection connected to the mount extension part, and a portion of the contact part connection is configured to be slidably insertable into the extension part connection, and a length of the parapet mount part is adjustable depending on a degree of insertion of the contact part connection.

2. The antenna mounting structure of claim 1, further comprising:

an angling wire connected to an upper end of the antenna at one end of the angling wire; and an angling part configured to adjust a degree of tilt of the antenna by length adjustment of the angling wire.

3. The antenna mounting structure of claim 2, wherein:

the angling part is a turnbuckle, wherein one end of the turnbuckle is connected to a first wire of the angling wire that is connected to the upper end of the antenna and the other end of the turnbuckle is connected to a second wire that is connected to the antenna mounting structure.

4. The antenna mounting structure of claim 2, wherein:

the angling part is a first winding roller, wherein one end of the angling wire is connected to an upper end of the antenna, and the first winding roller is configured to wind around the other end region of the angling wire.

5. The antenna mounting structure of claim 2, wherein:

the angling part comprising:

a second winding roller, one end of the angling wire is connected to an upper end of the antenna, and the second winding roller configured to wind around the other end region of the angling wire;

a warm gear connected with the second winding roller; and a worm engaged with the warm gear.

6. The antenna mounting structure of claim 2, wherein the antenna mounting structure further comprises a wire mount unit configured to mount the angling wire.

7. The antenna mounting structure of claim 1, wherein:

a distance between an inner surface of a parapet wall and the mount extension part is adjusted by adjusting a length of the first connecting means or changing a fastened state of the first connecting means to the inner surface of the parapet wall.

8. The antenna mounting structure of claim 7, wherein the mount extension part further comprises:

a vertical extension portion vertically connected to the parapet mount part;

a first auxiliary extension portion vertically coupled to the vertical extension portion, both ends of the first auxiliary extension portion is fixed by the first connecting means.

9. The antenna mounting structure of claim 7, wherein:

the parapet wall is in a form of an "L" shape comprising a first area perpendicular to a ground and a second area perpendicular to an end of the first area and parallel to the ground, the mount extension part further comprises a second auxiliary extension portion configured to be connected and fixed to a lower surface of the second region of the parapet wall by means of a second connecting means.

10. The antenna mounting structure of claim 1, wherein the antenna coupling part further comprises:

a lower coupling body; and an upper coupling body coupled to an upper area of the lower coupling body, and one or more first rotating coupling holes are formed on the lower coupling body, and the one or more first rotating coupling holes are arranged along an outer circumference of the lower coupling body so as to adjust rotary arrangement of the lower coupling body.

11. The antenna mounting structure of claim 10, wherein:

a second rotating coupling hole is formed in a region of the upper coupling body connected to the lower coupling body, the second rotating coupling hole is configured to adjust a tilted state of the antenna.

12. The antenna mounting structure of claim 1, wherein:

the antenna is disposed to extend in a direction parallel to the parapet contact part.

13. The antenna mounting structure of claim 1, further comprising:

a mount panel disposed below the parapet mount part.

14. A connection structure connecting a plurality of antenna mounting structures of claim 1, comprising one or more structure connections that are connected to the parapet mount part of each of the antenna mounting structures adjoining each other to fix the plurality of antenna mounting structures.

* * * * *